US009347667B2

(12) United States Patent
Carrere et al.

(10) Patent No.: US 9,347,667 B2
(45) Date of Patent: May 24, 2016

(54) INJECTOR FOR THE COMBUSTION CHAMBER OF A GAS TURBINE HAVING A DUAL FUEL CIRCUIT, AND COMBUSTION CHAMBER PROVIDED WITH AT LEAST ONE SUCH INJECTOR

(75) Inventors: Bernard Joseph Jean Pierre Carrere, Pau (FR); Jean-Luc Dabat, Lons (FR)

(73) Assignee: TURBOMECA, Bordes (FR)

( * ) Notice: Subject to any disclaimer, the term of this patent is extended or adjusted under 35 U.S.C. 154(b) by 371 days.

(21) Appl. No.: 13/982,608

(22) PCT Filed: Jan. 27, 2012

(86) PCT No.: PCT/FR2012/050177
§ 371 (c)(1),
(2), (4) Date: Jul. 30, 2013

(87) PCT Pub. No.: WO2012/104525
PCT Pub. Date: Aug. 9, 2012

(65) Prior Publication Data

US 2013/0305726 A1 Nov. 21, 2013

(30) Foreign Application Priority Data

Feb. 2, 2011 (FR) ..... 11 50807

(51) Int. Cl.
*F23R 3/28* (2006.01)
*F23D 11/10* (2006.01)
(Continued)

(52) U.S. Cl.
CPC ..... *F23R 3/28* (2013.01); *F23D 11/103* (2013.01); *F23D 11/107* (2013.01); *F23R 3/14* (2013.01); *F23R 3/343* (2013.01);
(Continued)

(58) Field of Classification Search
CPC ..... F23R 3/14; F23R 3/28; F23D 11/107
See application file for complete search history.

(56) References Cited

U.S. PATENT DOCUMENTS 4,817,389 A * 4/1989 Holladay ..... F02C 7/232 60/739
7,513,116 B2 4/2009 Hebert et al.
2007/0193272 A1* 8/2007 Hebert ..... F23D 11/107 60/740
(Continued)

FOREIGN PATENT DOCUMENTS

EP 1 953 455 8/2008

OTHER PUBLICATIONS

International Search Report Issued May 4, 2012 in PCT/FR12/050177 Filed Jan. 27, 2012.

*Primary Examiner* — Gerald L Sung
*Assistant Examiner* — Scott Walthour
(74) *Attorney, Agent, or Firm* — Oblon, McClelland, Maier & Neustadt, L.L.P.

(57) ABSTRACT

A starting injector usable in all flight modes without additional cost or weight. The starting injector includes a dual fuel circuit and an air circuit. An injector for a combustion chamber of a gas turbine includes a dual fuel injection circuit including a starting fuel circuit for ignition and then for all the flight modes, and a main fuel circuit for all the flight modes after starting. The circuits include parallel pipes in a common tube having an axis. The pipe of the starting circuit is substantially in communication with a center of a spherical injector body. At the end, the pipe accommodates an injection manifold coupled to a central channel passing through a central wall of a swirler. The pipe of the main circuit is in communication with an annular channel opposite jet channels. An air circuit is guided between two portions shaped as concentric spheres.

11 Claims, 5 Drawing Sheets

(51) Int. Cl.
*F23R 3/14* (2006.01)
*F23R 3/34* (2006.01)

(52) U.S. Cl.
CPC ..... *F23D 2900/00014* (2013.01); *F23D 2900/00015* (2013.01); *F23D 2900/00016* (2013.01)

(56) References Cited

U.S. PATENT DOCUMENTS

2008/0236165 A1 10/2008 Baudoin et al.
2010/0205971 A1* 8/2010 Williams ..... F23D 11/107 60/748

* cited by examiner

INJECTOR FOR THE COMBUSTION CHAMBER OF A GAS TURBINE HAVING A DUAL FUEL CIRCUIT, AND COMBUSTION CHAMBER PROVIDED WITH AT LEAST ONE SUCH INJECTOR

TECHNICAL FIELD

The invention relates to an injector for a combustion chamber of a gas turbine, in particular for a turbo-engine, comprising a dual fuel injection circuit. The invention also relates to a combustion chamber provided with at least one such dual circuit injector and with single circuit injectors.

An appropriate mixture of compressed air and fuel is in general injected into the combustion chamber with the help of a plurality of injectors. The injectors are mounted on the wall of a flame tube being arranged preferably in the chamber bottom. This allows the mixtures from the various injectors to be homogenously distributed.

In each injector, a nozzle introduces fuel into the end of a manifold. The fuel is adjusted in a centering guide. The air origin is the last stage of a compressor of the gas machine and the air is introduced into the injector in an annular way. Air and fuel are in general introduced into swirling devices with contra-rotation oriented channels or spins, and then the fuel particles are sprayed out in the air through a mixer. The mixture being ignited through a plug located at a determined distance is burnt out within the chamber. The gases being generated then possess a high kinetic energy that is used to generate propulsion or mechanical energy.

STATE OF THE ART

Nowadays, the chamber ignition is provided by two injectors being dedicated to starting, each starting injector being associated with a plug. The other injectors are dedicated to post-starting working conditions: acceleration or deceleration transient conditions and flight stabilized conditions. Such architecture needs to have available specific starting injectors, and thus, extra mass and specific mounting ports for such injectors on the flame tube supporting the set of injectors, as well as the positioning of resulting extra controls.

Furthermore, there are combustion chambers provided with injectors having a dual fuel supply circuit, an auxiliary circuit and a main circuit. The auxiliary circuit is dedicated to the idle operation, i.e. at low load, while the main circuit or both circuits is or are biassed at intermediate and stabilized ratings. At full power rate, the ratio of flow rates between both circuits is inverted and the main circuit becomes dominant or the unique fuel supplier. Such a distribution is disclosed for example in patent document FR 2,906,868 or FR 2,896,030 filed in the name of the Applicant.

However, such dual circuit injectors are not adapted to be used in the starting phase, because the structure thereof does not allow any mixture ejection at a high starting speed. That is the reason why the presence of specific injectors continues with the above-mentioned disadvantages.

DISCLOSURE OF THE INVENTION

The invention aims at remedying such problem by providing a starting injector also adapted to be used in any flight mode with no extra cost or mass. To do so, such starting injector possesses a particular configuration of a dual fuel supply circuit and an air circuit.

More precisely, the object of the present invention is to provide an injector for a gas turbine combustion chamber, comprising a dual fuel supply circuit and an air circuit. The fuel injection circuits consist in a starting fuel supply circuit being able to trigger the chamber ignition, and then to operate in any flight mode, and a main fuel supply circuit being able to operate in any flight mode further to starting. The fuel supply circuits have parallel conduits made in a common tube with a longitudinal axis. The conduit of the starting circuit opens, on one end, substantially into the center of a spherical injector body extending the common tube. On such end, the conduit houses an injection ring being able to drive fuel into rotation before projecting it inside the chamber through a central channel passing through a central wall of a swirling device. The conduit of the main circuit opens into an annular channel made in the body facing jet channels radially arranged in the main wall around the central channel. The air circuit is guided between two concentric sphere portions consisting of the injector body and a sheath surrounding the injector body and presenting an opening through which the swirling device opens into.

Thus, the injector according to the invention shows a highly reduced bulk thanks to the dual spherical architecture thereof.

Moreover, the central starting circuit is thermally protected from any coking through the fuel circulation in the annular channel of the main circuit. The main circuit is itself thermally protected by the peripheral air flow circulating in the inter-spherical space.

Advantageously, the swirling device is located in a slanting position with respect to the longitudinal axis of the injector. Such slanting configuration allows the end of the starting circuit to be positioned in the center of the latter and the air and fuel jets to be oriented in the direction of the plug arranged in the bottom of the chamber.

According to particular embodiments:

- the fuel conduit of the starting circuit shows on its end a cylindrical recess to house the ring;
- the central channel is made with a conical shape tapering towards the inside part of the combustion chamber into which it opens;
- the radial channels show a slanting orientation with respect to the axis of the central channel and in contra-rotation with respect to the slant of the fins of the swirling device; the air flow on the injector outlet then forms an air cone surrounding the fuel cone of the main circuit;
- the injection ring of the starting circuit is helical;
- the annular channel of the main fuel supply circuit is not looped on itself and shows ends so as not to form any "dead" zone where the fuel might stagnate; and
- the number of radial channels is equal to a multiple of the fin number of the swirling device.

The invention also relates to a combustion chamber provided of at least one dual circuit injector as shown above and single circuit injectors. All the injectors are mounted in alignment on the casing surrounding the combustion chamber and cross a flame tube through ports arranged along at least one line parallel to the longitudinal axis of the flame tube.

The dual circuit injectors are oriented towards the ignition plug so that such injectors are able to project an air/fuel cone on the output of the swirling device oriented towards the combustion chamber bottom.

In a preferred embodiment, the combustion chamber is provided with two dual circuit injectors being not adjacent on the line of injectors.

BRIEF DESCRIPTION OF THE FIGURES

Other characteristics and advantages of the present invention will appear from the reading of the detailed exemplary embodiment that follows, referring to the accompanying figures wherein, respectively.

DETAILED DESCRIPTION

Figure 1A:
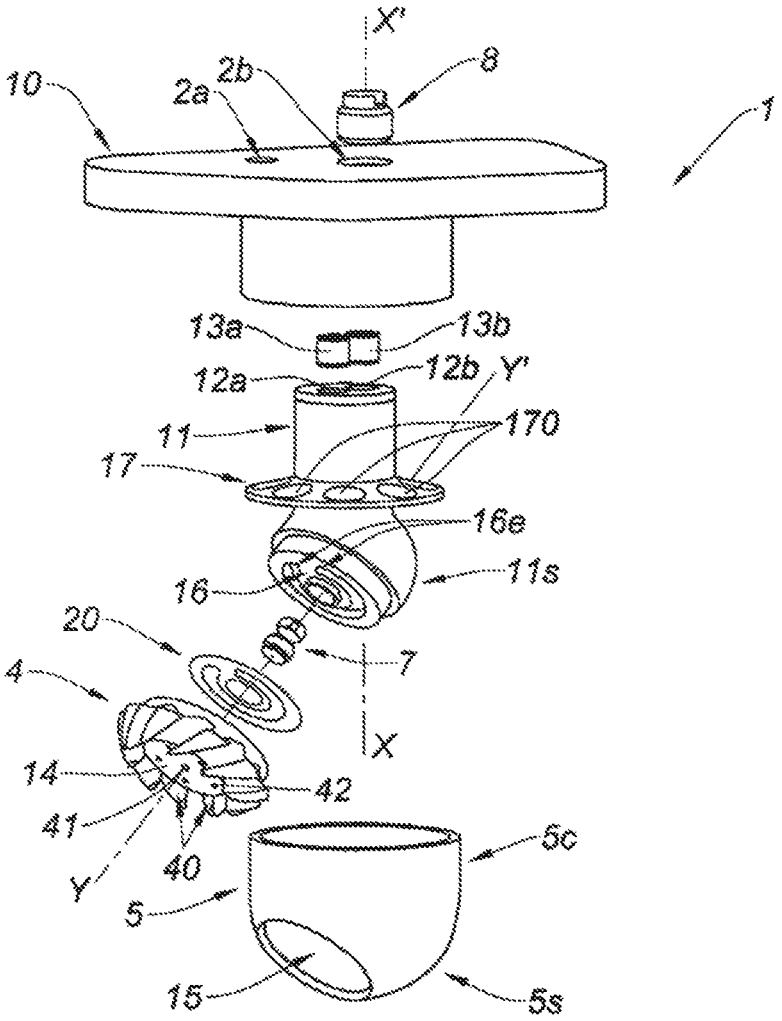
FIGS. 1*a* and 1*b* show an exploded view and a sectional view of an exemplary dual circuit injector according to the invention.
Figure 1B:
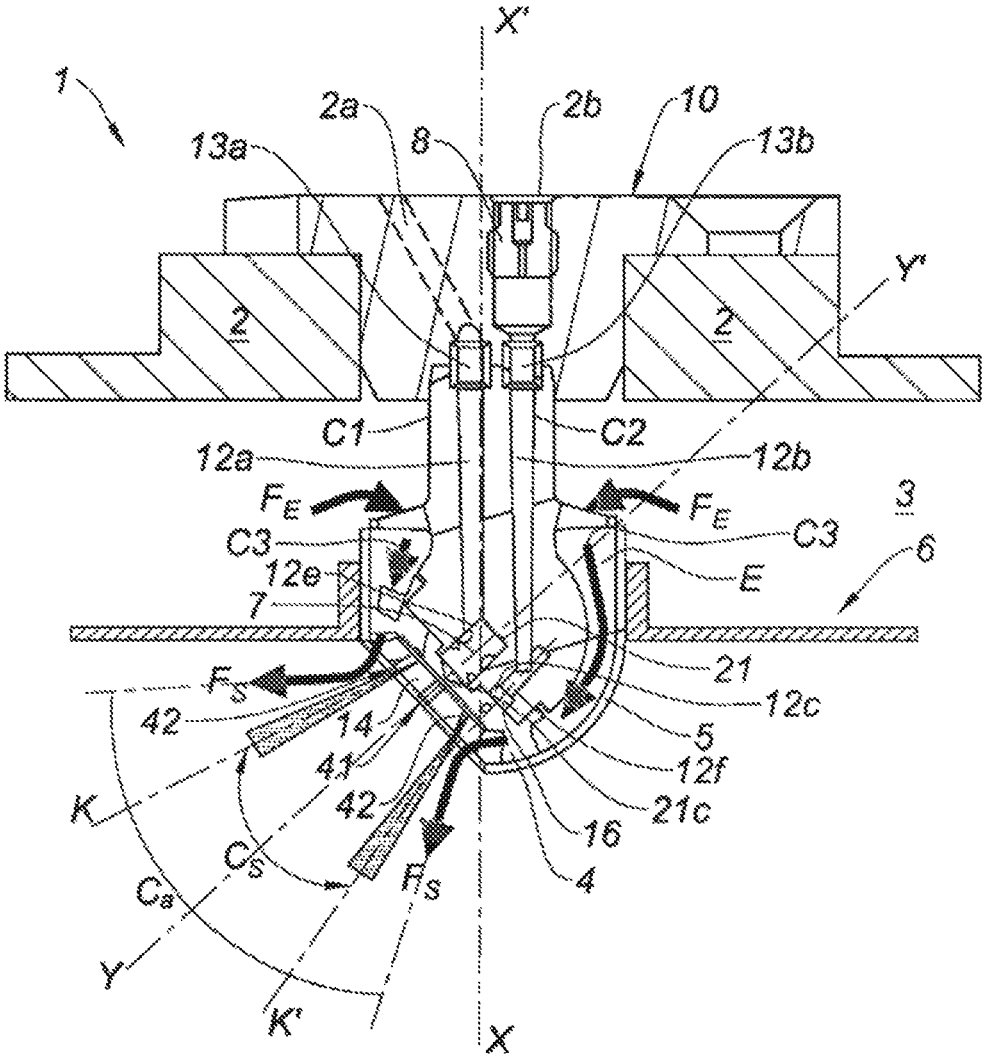

Referring to the exploded view and the sectional view of respective FIGS. 1*a* and 1*b*, an injector 1 according to the invention comprises a fastening flange 10 on a casing 2 of an annular combustion chamber 3, a common tube 11 with a longitudinal axis X'X referring to the injector, and a circular swirling device 4 with a central wall 14 and an axis of symmetry Y'Y slanting with respect to the axis X'X. Such central wall 14 allows the projection, through the opening 15 of a sheath 5, of an air/fuel mixture in a flame tube 6 abutting against the sheath 5. The swirling device 4 is sized so that the fins 40 of such swirling device, being regularly distributed on the periphery of the central wall 14, abut in a self-adjusted and self-centered way against the edge of the opening 15.

The dual fuel injection circuit consists in a starting fuel supply circuit C1 being able to trigger the ignition of the chamber 3 and to operate in any flight mode, and a main fuel supply circuit C2 able to operate in any flight mode further to starting.

The circuits C1 and C2 are coupled with fuel supply manifolds (not shown). Such circuits are made of access borings 2*a*, 2*b* formed in the fastening flange 10, in connection with the parallel longitudinal conduits, respectively 12*a* and 12*b*, extending in the tube 11 while abutting on sealing sleeves 13*a* and 13*b* housed within such tube. Such conduits extend in the tube 11 parallel to the longitudinal axis X'X and open into the combustion chamber 3 through the central wall 14.

Concerning the starting circuit C1, the conduit 12*a* opens—on one end 12*e*—substantially into the center of a hemispheric injector body 11*s* in the extension of the tube 11. Moreover, on such end, the conduit 12*a* houses—in a cylindrical recess 21 with a slanting axis merged into the axis Y'Y of the swirling device 4—a helical fuel ring 7. Advantageously, the recess 21 presents a conical end 21*c* coupled through the central wall 14 of the swirling device 4 with a central channel 41 with an axis merged into the axis Y'Y of the swirling device 4 or the recess 21. Such central channel 41 opens into the combustion chamber 3.

As regards the main circuit C2, a nozzle 8 is advantageously mounted in the access boring 2*b* of the flange 10. Such nozzle enables to calibrate the fuel flow rate that varies according to the flight phases. After an elbow 12*c*, the longitudinal conduit 12*b* is oriented into a final portion 12*f* parallel to the axis Y'Y and opens into an annular channel 16 arranged in the spherical body 11*s*. Such annular channel 16 has advantageously two ends 16*e*. In other words, such channel is not looped on itself. Thus, no "dead" zone is formed, where the fuel might stagnate.

The annular channel 16 is brazed on the central wall through an appropriate brazing 20, that makes the non looped shape of the annular channel 16 appear. Such an annular channel 16 communicates with jet channels 42 radially arranged and equally distributed around the central channel 41. Advantageously, such jet channels have the same diameter. The radial channels 42 advantageously have an orientation according to axes K'K symmetrically slanted with respect to the axis Y'Y of the central channel 41 (see in particular FIG. 1*b*) and in contra-rotation with respect to the slanting of the fins 40 of the swirling device 4. Advantageously, the number of radial channels 42 is equal to a multiple of the number of fins 40 of the swirling device 4.

Furthermore, the air flow on the input $F_E$—such air coming from the last compression stage—crosses openings 170 formed in a flared cover 17 extending the tube 11 and is then guided in an air circuit C3, where the air is circulating within an inter-spherical space "E". Such space "E" is formed between two portions of concentric spheres provided by the injector body 11*s* and partially by the sheath 5 in a spherical part 5*s* surrounding the injector body 11*s*. The sheath also presents a circular section cylindrical part 5*c*, which allows an abutment to be provided for the flame tube 6 and for the flared cover 17 of the tube 11. Thus, the injector according to the invention presents a minimal bulk thanks to such inter-spherical passageway.

Moreover, the central starting circuit C1 is thermally protected from coking by the fuel circulation flow within the annular channel 16 of the main circuit C2, such main circuit being itself thermally protected by the peripheral air flow F circulating within the inter-spherical space "E" of the air circuit C3.

On the injector output 1, the air flow $F_S$ advantageously forms, while passing between the fins 40, an air cone Ca surrounding the fuel discharge cone "E" of the main circuit C2.

Figure 2A:
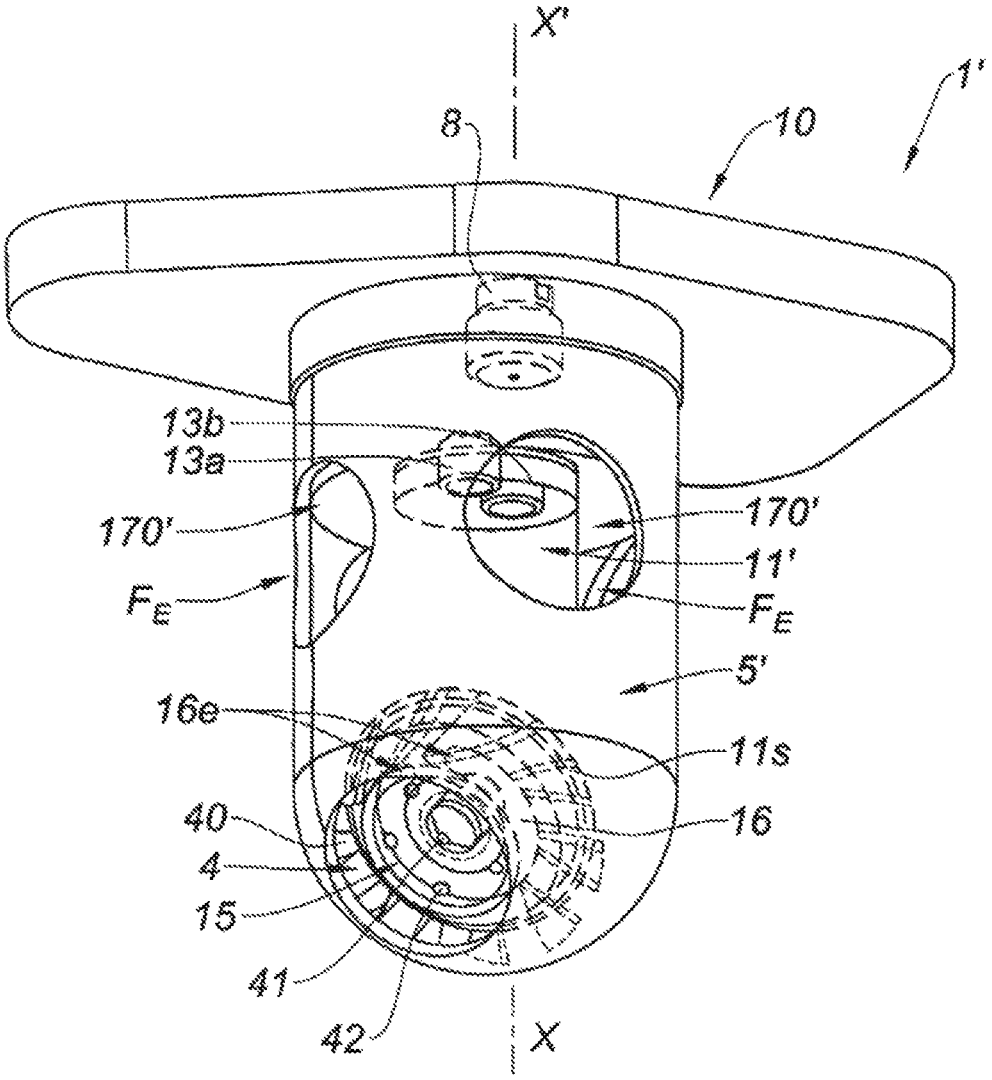
FIGS. 2*a* and 2*b* show a perspective view and a sectional view of a variation of the preceding example.
Figure 2B:
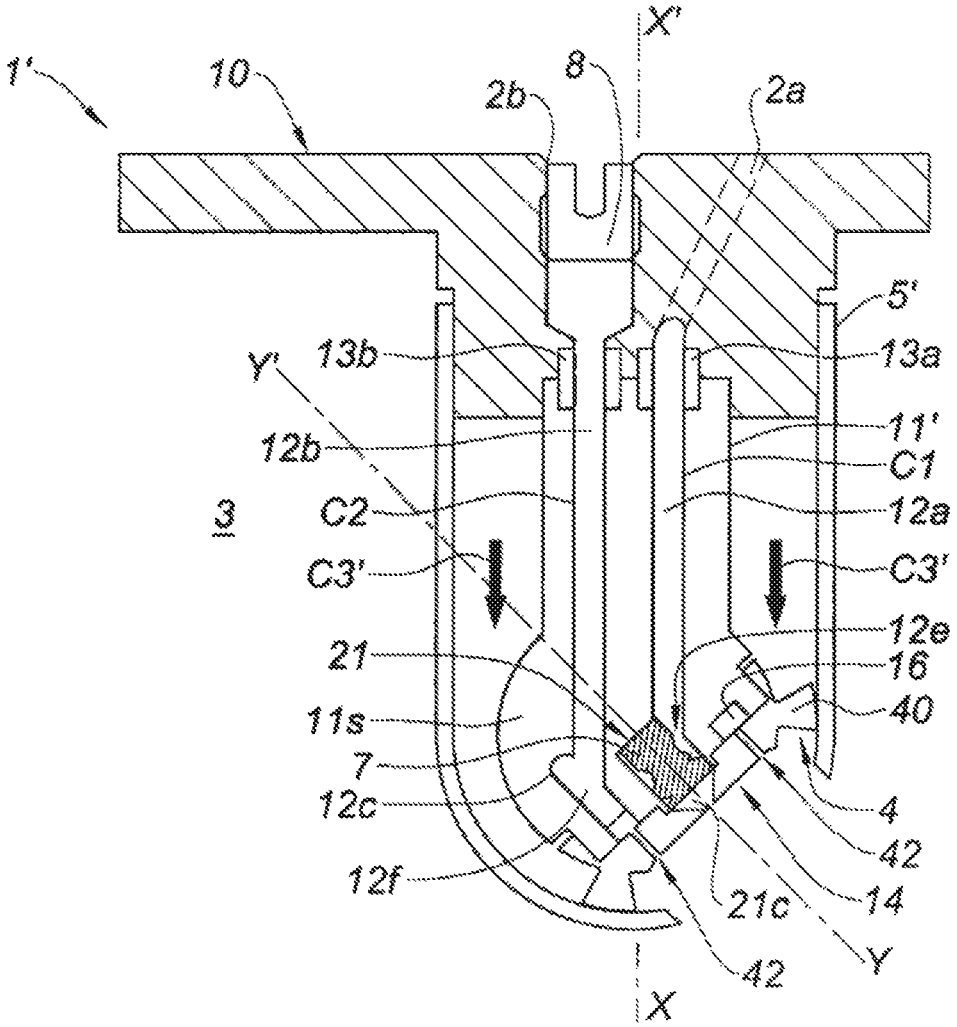

According to an alternative embodiment referring to the perspective and sectional views of FIGS. 2*a* and 2*b*, the injector 1' being shown takes again elements of the preceding example. Such identical elements are thus represented with the same reference numerals: the preceding description of such elements directly apply to FIGS. 2*a* and 2*b* in their structure and their function.

The modifications essentially come from the configuration in the connection between the longitudinal tube 11 and the sheath 5. In the example illustrated on FIGS. 2*a* and 2*b*, the tube 11' has no flared cover 17 to form the access openings 170 for the air flow $F_E$ in the circuit C3. Here, the tube 11' is directly extended by the spherical body 11*s*. And the sheath 5' is extended in its cylindrical part up to be fastened on the flange 10. The passing openings 170' for the air flow $F_E$ in the circuit C3' are then arranged in the cylindrical part of the sheath 5', on the side of the flange 10. The conical end part 21*c* of the recess 21 crosses the central wall 14 of the swirling device 4 and is operated as a central channel 41.

Figure 3:
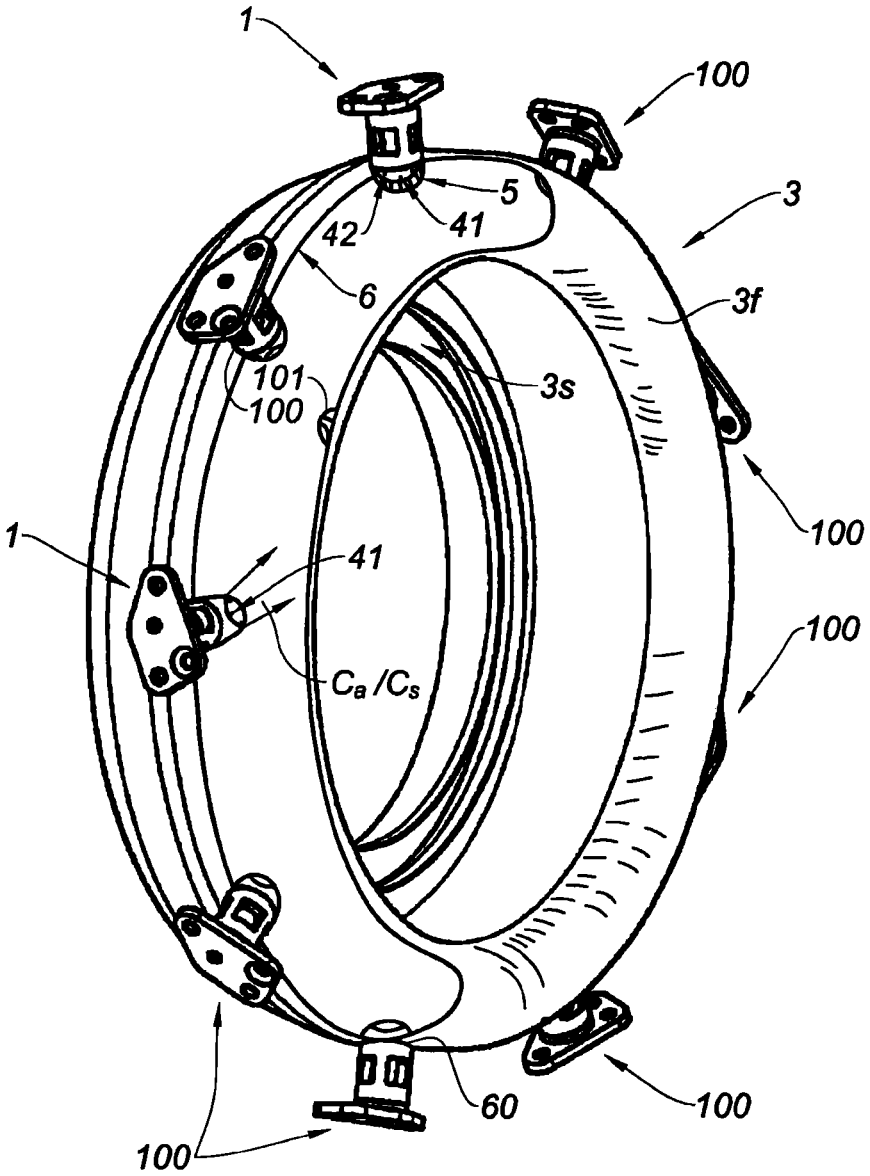
FIG. 3 shows a partial perspective view of a combustion chamber provided with dual circuit injectors as shown above and single circuit injectors.

Referring to FIG. 3, the part perspective view illustrates the combustion chamber 3 provided with injectors being mounted on the wall of the flame tube 6: two dual circuit injectors 1 as shown above and seven single circuit injectors 100. The chamber is partially exploded so as to show some injectors totally and the plug 101 from the bottom 3*f* side of the chamber.

All the injectors 1, 100 are regularly mounted on the annular rim of the chamber 3. Ports 60 have been provided in the tube 6 so as to enclose the sheaths 5 of the injectors 1, 100.

The dual circuit injectors 1 are oriented towards the igniting plug 101. Thanks to the slanting orientation of the jet channels 42 and the central channels 41, the dual circuit injectors 1 are able to project air/fuel cones Ca/Cs on the output of the swirling devices towards the bottom 3*f* of the combustion chamber 3. After ignition, the flame is directed towards the bottom 3*f*, returns back and goes out through the opposite output 3*s*.

In the example being illustrated, the two dual circuit injectors 1 are separated by a single circuit injector 100 so as to make the orientation of the dual circuit injectors 1 easier towards the plug 101.

The invention is not limited to the embodiment being disclosed and represented. For example, the injector body can form a more or less complete sphere part according to the opening size or the diameter of the common tube. Furthermore it is possible to form various injector lines in the flame tube.

The invention claimed is:

1. A dual fuel circuit injector for a gas turbine combustion chamber, comprising:

fuel supply circuits including a starting fuel supply circuit configured to supply fuel during chamber ignition, and to operate in any flight mode, and a main fuel supply circuit configured to operate in any flight mode subsequent to starting, and an air circuit, wherein the starting fuel supply circuit and the main fuel supply circuit include parallel conduits made in a common tube with a longitudinal axis, wherein the conduit of the starting fuel supply circuit opens, on one end, substantially into a center of a spherical injector body at a downstream end of the common tube, with respect to fuel flow through the common tube, and, on the one end, the conduit of the starting fuel supply circuit houses an injection ring configured to drive fuel into rotation before projecting the fuel inside the gas turbine combustion chamber through a central channel passing through a central wall of a swirling device, wherein the conduit of the main fuel supply circuit opens into an annular channel made in the spherical injector body facing jet channels radially configured in the central wall of the swirling device around the central channel, the annular channel being C-shaped to include two separated channel ends and being fixed to an upstream face of the central wall of the swirling device, with respect to fuel flow, and wherein air in the air circuit is guided in a passage delimited between the spherical injector body and a spherical portion of a sheath surrounding the spherical injector body, the sheath including an opening into which the swirling device opens, wherein a plane defined by a downstream face of the central wall of the swirling device, with respect to fuel flow, is offset from the opening of the sheath along an axis of the swirling device.

2. The dual fuel circuit injector according to claim 1, wherein the swirling device is located in a slanting position with respect to a longitudinal axis of the dual fuel circuit injector so as to position the one end of the starting fuel supply circuit in the center of the spherical injector body and to orient the air and the jet channels in a selected direction inside the gas turbine combustion chamber.

3. The dual fuel circuit injector according to claim 1, wherein the one end of the conduit of the starting fuel supply circuit includes a cylindrical recess to house the injection ring.

4. The dual fuel circuit injector according to claim 1, wherein the central channel includes a conical shape tapering towards an inside part of the gas turbine combustion chamber into which the central channel opens.

5. The dual fuel circuit injector according to claim 1, wherein the swirling device comprises slanting fins, the jet channels have a slanting orientation with respect to an axis of the central channel and in contra-rotation with respect to the slanting fins of the swirling device.

6. The dual fuel circuit injector according to claim 1, wherein the injection ring is helical.

7. The dual fuel circuit injector according to claim 5, wherein a number of jet channels is equal to a multiple of a number of slanting fins of the swirling device.

8. A gas turbine combustion chamber comprising at least one dual fuel circuit injector according to claim 1, and single fuel circuit injectors, wherein each and every injector of the at least one dual fuel circuit injector and single fuel circuit injectors is mounted in alignment on a casing surrounding the gas turbine combustion chamber and cross a flame tube through ports arranged along a circumference of the flame tube at a common axial location.

9. The gas turbine combustion chamber according to claim 8, wherein the at least one dual fuel circuit injector is oriented towards an ignition plug so that the at least one dual fuel circuit injector is configured to project an air/fuel cone from an output of the swirling device oriented towards a bottom of the gas turbine combustion chamber.

10. The gas turbine combustion chamber according to claim 8, comprising two dual fuel circuit injectors not adjacent to each other on the circumference of the flame tube at the common axial location.

11. The dual fuel circuit injector according to claim 1, wherein the central wall is circular.

* * * * *